US005175029A

United States Patent [19]

Peterson

[11] Patent Number: 5,175,029

[45] Date of Patent: Dec. 29, 1992

[54] CHRISTMAS TREE ORNAMENT WITH PHOTO DISPLAY

[76] Inventor: Laverne R. Peterson, 23 Lewley Street, North Beach 6020, Australia

[21] Appl. No.: 772,874

[22] Filed: Oct. 8, 1991

[51] Int. Cl.[5] ..... A47G 33/08

[52] U.S. Cl. ..... 428/7; 428/13; 428/34.1; 428/542.8

[58] Field of Search ..... 428/7, 11, 13, 34.1, 428/542.8

[56] References Cited

U.S. PATENT DOCUMENTS

| | | | |
|---|---|---|---|
| 3,035,162 | 5/1962 | Emmich | 428/7 X |
| 3,220,913 | 11/1965 | Thomas | 428/11 X |
| 3,694,648 | 9/1972 | Yates | 428/11 X |
| 4,309,464 | 1/1982 | Rauch | 428/11 |
| 4,492,723 | 1/1985 | Chadwick, II | 428/7 |
| 4,517,040 | 5/1985 | Whitted | 428/11 X |
| 4,592,936 | 6/1986 | Ferguson | 428/11 |
| 4,889,748 | 12/1989 | Dudley | 428/11 |
| 4,939,004 | 7/1990 | Fuss | 428/9 |
| 4,947,722 | 8/1990 | Lewis | 428/7 X |

*Primary Examiner*—Henry F. Epstein
*Attorney, Agent, or Firm*—Richard C. Litman

[57] ABSTRACT

Disclosed is a Christmas tree ornament formed of three transparent plastic parts, a top member, a bottom member and an internal member. Photographs and messages may be mounted on the internal member, the internal member and the top member being attached to the bottom member by suitable attachment means including mating pins and apertures, adhesives and mating lips, depressions and rims. The top member may be configured as a cone, a cylindrical barrel or a portion of a sphere. The internal member is generally pyramid-shaped, providing three large triangular portions for supporting photographs and three separating panels on which messages may be placed. In a second embodiment of the internal member the triangular portions have a substantially convex surface configured substantially like a lens. The bottom member may also be formed as a substantially convex wall. The attaching means include pins and holes, and adhesive. The ornament is intended to be sold in kit form whereby the owner may mount his own photographs on the internal member and then seal the internal member within the top and bottom member before hanging the ornament on a Christmas tree.

14 Claims, 3 Drawing Sheets

CHRISTMAS TREE ORNAMENT WITH PHOTO DISPLAY

BACKGROUND OF THE INVENTION

1. Field Of The Invention

This invention relates to a Christmas tree ornament having provision for mounting up to three photographs together with messages on an internal mounting frame. The internal mounting frame is attached to a bottom piece, which in turn is attached to a top piece, whereby the photographs and messages can be sealed by the owner within a transparent ornament which may be hung on a Christmas Tree.

2. Description Of Related Prior Art

U.S. Pat. No. 3,035,162, issued May 15, 1962 to Eugene Emmich, discloses Christmas tree ornaments connected to a source of air whereby motion may be imparted to selected portions of the ornaments by expansion and contraction of the ornaments or by blowing flocculent material to create the effect of falling snow. There is no disclosure by Emmich of any means to internally mount a photograph.

U.S. Pat. No. 3,694,648, issued Sep. 26, 1972 to Robert L. Yates, discloses a Christmas tree ornament having a lens and a light built into the ornament, together with an externally accessible slot for receiving a transparency which then may be viewed through the lens. There is no disclosure by Yates of any means for internally mounting a photograph and/or messages.

U.S. Pat. No. 4,309,464, issued Jan. 5, 1982 to Marshall A. Rauch, discloses a Christmas tree ornament formed of a molded polystyrene ball covered with strand material such as rayon acetate yarn. Adhered to the outer surface of the ball is a decoration such as a photograph. There is no disclosure by Rauch of any means for internally mounting a photograph within a transparent Christmas tree ornament.

U.S. Pat. No. 4,517,040, issued May 14, 1985 to Linda J. Whitted, discloses a Christmas tree ornament having a photograph mounted on a mirrored surface wherein a portion of the mirrored surface has been removed, the mirrored surface having the photograph mounted thereon being inserted in an opening in the outer shell of the Christmas tree ornament. There is no disclosure by Whitted of any means for internally mounting a photograph on a central member within a transparent Christmas tree ornament.

U.S. Pat. No. 4,889,748, issued Dec. 26, 1989 to Roger W. Dudley discloses a Christmas tree ornament 30 having a central member 31 attached thereto entirely about its circumference, said central member being designed to carry, at most, two photographs which inherently would have to be factory mounted. There is no disclosure how the outer shell can be removed so as to allow the owner to insert and remove or exchange his or her own photographs.

SUMMARY AND OBJECTS OF THE INVENTION

It is an object of this invention to provide a Christmas tree ornament which enables an owner to place up to three photographs within the ornament before sealing the ornament and hanging the ornament on a Christmas tree.

It is a further object of this invention to provide a Christmas tree ornament initially disassembled enabling the placement of up to three photographs on an internal member by an owner prior to assembly.

It is a still further object of this invention to provide a photo carrying Christmas tree ornament in kit form, comprising three easily engageable pieces.

These and other objects are achieved by providing a Christmas tree ornament formed of clear transparent plastic, comprising three pieces, a top piece, a bottom piece and an internal picture supporting piece. The internal picture supporting piece is configured to support a photograph and/or written material on at least three sides. The internal picture supporting piece, after mounting the photographs and/or written material, is then attached to the bottom piece, and the bottom piece subsequently is attached to the top piece. In a first preferred embodiment the internal picture supporting piece is provided with triangular flat surfaces for mounting the photographs, while the top and bottom pieces together have a tear-drop shape, the top piece forming a cone, and the bottom piece shaped like an eye glass. A second embodiment is spherically shaped, with the triangular surfaces of the internal member being substantially curved. A third embodiment has a barrel shaped top piece, a bottom piece shaped like an eye glass and a pyramid shaped internal piece.

Other objects, features and advantages of this invention will become apparent from the following detailed description and the appended claims, reference being had to the accompanying drawings forming a part of the specification, wherein like reference numerals designate corresponding parts of the several views.

DETAILED DESCRIPTION OF THE PREFERRED EMBODIMENT

Before explaining in detail the present invention, it is to be understood that the invention is not limited in its application to the details of construction and arrangement of parts illustrated in the accompanying drawings, since the invention is capable of other embodiments and of being practiced or carried out in various ways. Also, it is to be understood that the phraseology and terminology employed herein is for the purpose of description and not limitation.

Figure 1:
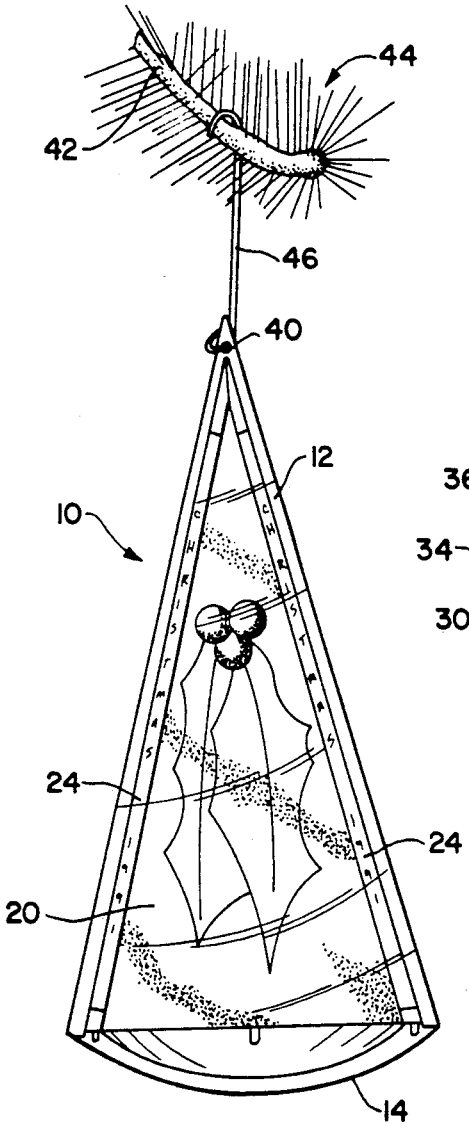
FIG. 1 is a perspective view of the preferred embodiment of a Christmas tree ornament having substantially a tear-drop shape.
Figure 3:
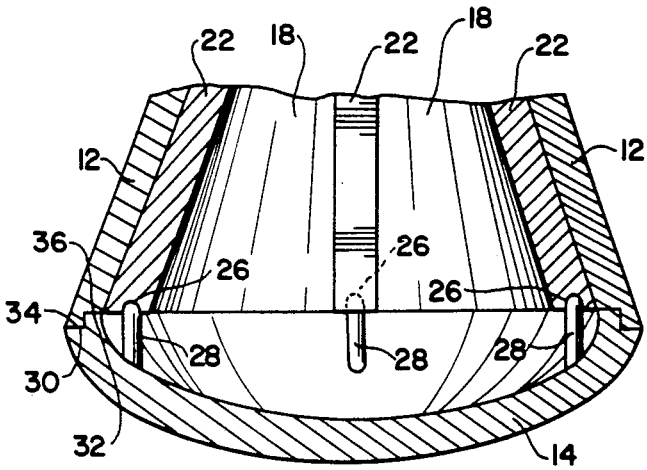
FIG. 3 is a cross-sectional view of the embodiment of FIG. 1 showing how the internal picture supporting member is attached to the bottom member and how the bottom member is attached to the top member.
Figure 2:
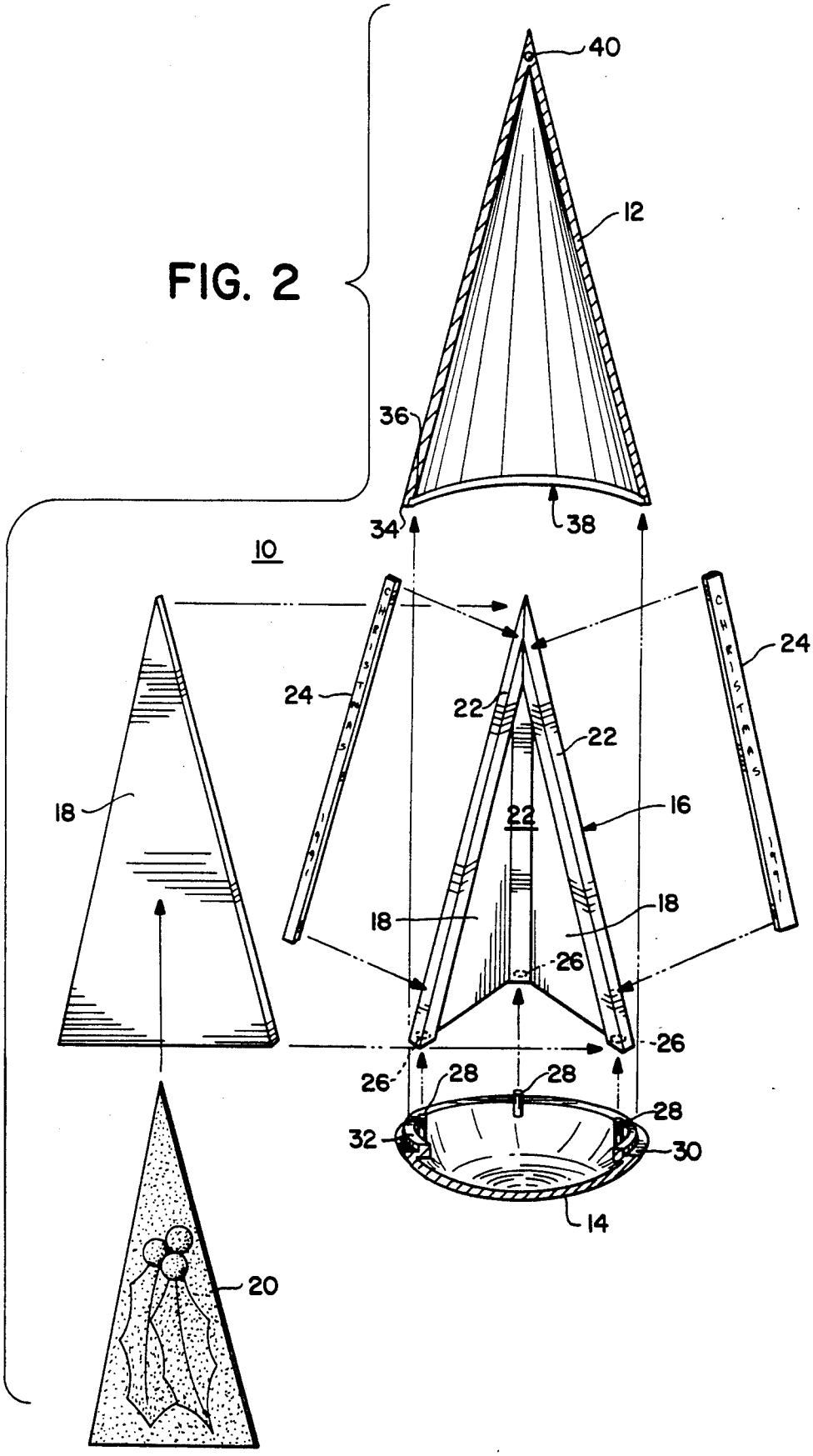
FIG. 2 is an exploded perspective view showing the structure of the several elements.

Christmas tree ornament 10, shown in FIGS. 1, 2 and 3, comprises a top member 12 formed of transparent plastic and which is cone shaped, a bottom member 14 which is convex-shaped in a manner similar to an eyepiece or lens, and also formed of transparent plastic, and a substantially pyramid shaped internal picture supporting member 16. Internal picture supporting member 16 has three triangularly shaped surfaces 18 for supporting a triangularly shaped photograph or the like 20. Surfaces 18 are separated by three narrow panels 22 which may be tapered at the top as shown in FIGS. 1 and 2, or have a triangular configuration, the panels 22 serving to support short messages, as shown by rectangular sheets 24.

As shown in FIGS. 2 and 3, panels 22 each have a hole 26 for receiving a mating pin 28 extending from bottom member 14 whereby internal picture supporting member 16 is attached to bottom member 14 after photographs 20 and sheets 24 have been properly mounted on surfaces 18 and panels 22. The attachment may be aided by using a suitable adhesive.

Bottom member 14 also includes a circular rim 30 bounded by a circular raised lip 32, which mate with a circular rim 34 and a circular depression 36 provided on the base 38 of top member 12, whereby top member 12 may be attached to bottom member 14 either by a press fit or through the use of adhesive materials.

A hole 40 is placed in top member 12 whereby ornament 10 may be hung on a branch 42 of a Christmas tree 44 by means of a hook or the like 46.

Figure 4:
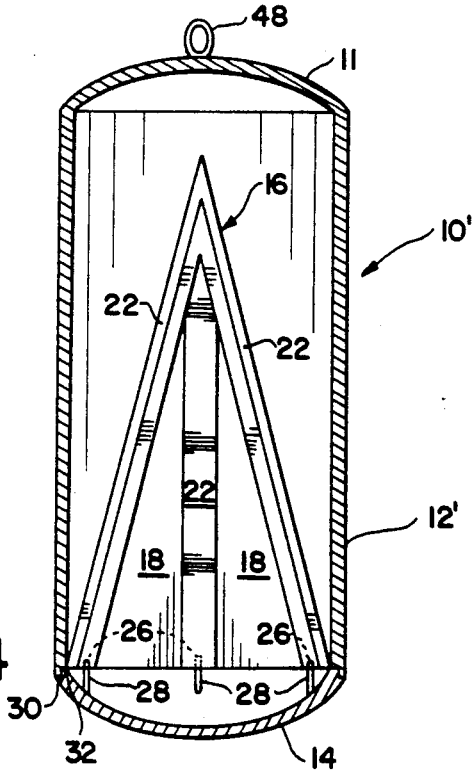
FIG. 4 is a cross-sectional view of a second embodiment having a barrel shaped top member.

Christmas tree ornament 10' in FIG. 4 is similar to Christmas tree ornament 10 in terms of function but is different in terms of structure. Ornament 10' includes a top member 12', a bottom member 14 and an internal member 16 as in FIGS. 1, 2 and 3. Top member 12' differs from top member 12 in that top member 12' is cylindrically or barrel-shaped rather than cone-shaped. Also, top member 12' has an eyelet 48 at the convex lens-like top 11 thereof for receiving a hook or the like similar to hook 46. The parts of the embodiment of FIG. 4 are assembled in the same manner as the embodiment of FIGS. 1, 2 and 3.

Figure 5:
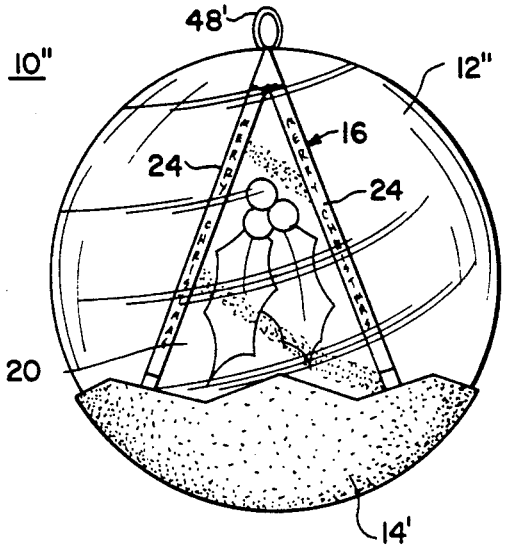
FIG. 5 is a perspective view of a third embodiment showing a spherical Christmas tree ornament with a substantially pyramid shaped internal picture supporting member.
Figure 6:
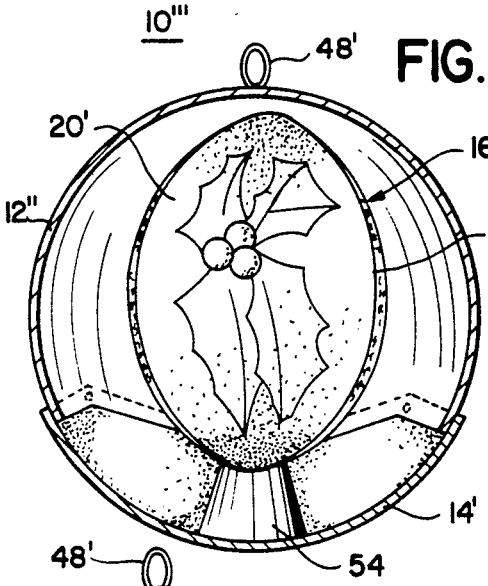
FIG. 6 is a cross-sectional view of the embodiment of FIG. 5 wherein the sides of the internal picture supporting member are curved convexially to approximate the curve of the top and bottom members.
Figure 7:
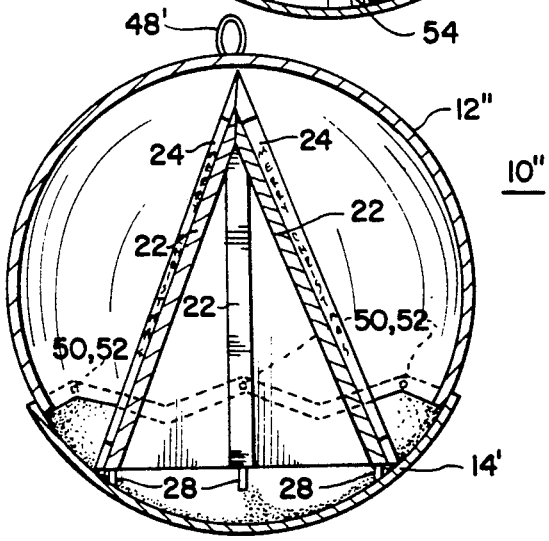
FIG. 7 is a cross-sectional view of the embodiment of FIG. 5 showing how the internal picture supporting member is attached to the bottom member.
Figure 8:
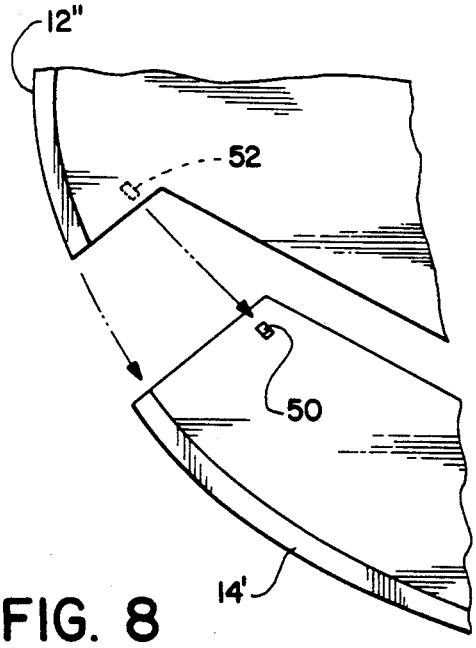
FIG. 8 is a partial view of the embodiment of FIG. 5 showing how the bottom member is attached to the top member.

A third embodiment of a Christmas tree ornament 10'' is shown in FIGS. 5 and 7, and a fourth embodiment 10''' is shown in FIG. 6. FIG. 8 illustrates how bottom member 14' is attached to top member 12'' by means of pins 50 located in bottom member 14' which engage apertures 52 located in top member 12''. In FIGS. 5, 7 and 8, top member 12'' and mating bottom member 14' are substantially spherical in configuration, with the radius for the bottom member 14' being slightly larger than the radius for top member 12'' so as to enable the bottom member 14' to overlap the top member 12'' as shown. Internal picture supporting member 16 in FIGS. 5 and 7 is effectively the same as in FIGS. 1–4, inclusive, with pins 28 extending from bottom member 14' to holes 26 in narrow separating panels 22, whereby internal picture supporting member 16 is attached to bottom member 14'. At the top of top member 12'' an eyelet 48' is provided to enable ornaments 10'' and 10''' to be hung on a tree or the like.

In FIG. 6, the triangular surfaces 18' forming a means for supporting photographs 20' on internal member 16' are configured as generally convex surfaces, member 16' being attached to bottom member 14'' as by means of an adhesive, the internal member 16' resting on a cone frustum 54 as shown.

Dimensionally it is intended that the pyramids forming the internal members be approximately the same size, the triangularly shaped surfaces 18 being approximately 2 inches in length at the base, with the separating panels 22 being approximately $\frac{3}{8}$ inch wide. The height of the cone-shaped top member 12 is approximately $4\frac{1}{2}$ inches. The base of the cone shaped top member 12 has a diameter of approximately $2\frac{1}{2}$ inches. The height of the barrel-shaped tree ornament 10' of FIG. 4 is approximately 4 inches. The diameter of the spherical ornaments 10'', 10''' of FIGS. 5–8, inclusive, is approximately $3\frac{7}{8}$ inches. The eyelet for each embodiment is approximately $\frac{1}{4}$ inch in height.

These dimensions provide more than adequate room to store and display up to three photographs together with switchable messages. It is contemplated that these tree ornaments will be sold disassembled in kit form to enable the purchaser to mount his or her own photographs and/or messages, and thereafter assemble the tree ornaments for his or her own use.

While it will be apparent that the preferred embodiment of the invention herein disclosed is well calculated to fulfill the objects above-stated, it will be appreciated that the invention is susceptible to modification, variation and change without departing from the proper scope or fair meaning of the subjoined claims.

I claim:

1. A Christmas tree ornament for mounting and displaying a plurality of photographs and messages, comprising:

a top member formed of transparent plastic material;

a bottom member formed of transparent plastic material and attached to said top member;

an internal member for supporting the photographs and messages, said internal member being a single piece having a plurality of viewing surfaces interconnected by narrow separating panels and attached to said bottom member, said viewing surfaces and narrow separating panels adapted for mounting photographs and messages, respectively, thereto and clearly visible through said top member;

whereby the photographs and messages may be sealed within the Christmas tree ornament.

2. A Christmas tree ornament as in claim 1 wherein:

said top member is configured as a cone having a hole at the top thereof;

said bottom member is configured to mate with said cone, said bottom member providing a uniformly convex wall; and said internal member is configured substantially as a six sided pyramid, with three triangular viewing surfaces for supporting at least three similarly-sized, triangularly shaped photographs, and three narrow separating panels effective to support messages.

3. A Christmas tree ornament as in claim 2, further comprising means for attaching said internal member to said bottom member, including:

holes disposed in a bottom end of said separating panels on said internal member; and pins extending from said bottom member and inserted into said separating panel holes to thereby attach said internal member to said bottom member.

4. A Christmas tree ornament as in claim 3, further comprising means for attaching said bottom member to said top member, including:

a circumferential rim encircling a circumferential lip on said bottom member; and a circumferential rim encircling a circumferential depression on said top member corresponding to and matable with said circumferential rim and circumferential lip respectively, on said bottom member.

5. A Christmas tree ornament as in claim 1, further comprising means for attaching said internal member to said bottom member including:

holes disposed in a bottom end of said separating panels on said internal member; and pins extending from said bottom member and inserted into said holes to thereby attach said internal member to said bottom member.

6. A Christmas tree ornament as in claim 5, further comprising means for attaching said bottom member to said top member, including:

a circumferential rim encircling a circumferential lip on said bottom member; and a circumferential rim encircling a circumferential depression on said top member corresponding to and matable with said circumferential rim and circumferential lip respectively, on said bottom member.

7. A Christmas tree ornament as in claim 1, wherein:

said top member is configured as a cylindrical barrel with a convex top having an eyelet centrally disposed thereon;

said bottom member is configured to mate with said cylindrical barrel, said bottom member providing a uniformly convex wall; and said internal member is configured substantially as a six sided pyramid, with three triangular viewing surfaces for supporting at least three triangularly shaped photographs, and three narrow separating panels effective to support messages.

8. A Christmas tree ornament as in claim 7, further comprising means for attaching said internal member to said bottom member including:

holes disposed in a bottom end of said separating panels on said internal member; and pins extending from said bottom member and inserted into said holes to thereby attach said internal member to said bottom member.

9. A Christmas tree ornament as in claim 8, further comprising means for attaching said bottom member to said top member, including:

a circumferential rim encircling a circumferential lip on said bottom member; and a circumferential rim encircling a circumferential depression on said top member corresponding to and matable with said circumferential rim and circumferential lip, respectively, on said bottom member.

10. A Christmas tree ornament as in claim 7, further comprising means for attaching said bottom member to said top member, including:

a circumferential rim encircling a circumferential lip on said bottom member; and a circumferential rim encircling a circumferential depression on said top member corresponding to and matchable with said circumferential rim and circumferential lip, respectively, on said bottom member.

11. A Christmas tree ornament as in claim 1, wherein:

said top member and said bottom member are configured substantially as a sphere;

said top member having a first radius of curvature;

said bottom member having a second radius of curvature sufficiently larger than said first radius of curvature such that said bottom member overlaps said top member when attached to said top member; with attachment means for attaching said bottom member to said top member and said internal member to said bottom member; and an eyelet disposed on said top member in a central location.

12. A Christmas tree ornament as in claim 11, wherein:

said internal member is configured as a six sided pyramid, with three triangular viewing surfaces for supporting at least three similarly-sized, triangularly shaped photographs, and three narrow separating panels effective to support messages; with said attachment means comprising holes disposed in the bottom of said separating panels of said internal member, first pins extending from said bottom member into said holes to thereby attach said internal member to said bottom member, and second pins extending from an upper periphery of said bottom member and engaging apertures disposed around the lower periphery of said top member.

13. A Christmas tree ornament as in claim 11, wherein:

said internal member is substantially egg-shaped with convex surfaces for supporting photographs and messages;

said bottom member including a conical frustum, said internal member being attached to a curved surface of said frustum by adhesive means forming a part of said attachment means; with said attachment means further comprising pins extending from an upper periphery of said bottom member and engaging apertures disposed around a lower periphery of said top member.

14. A kit for assembling a Christmas tree ornament comprising:

a top member formed of transparent plastic material;

a bottom member formed of transparent plastic material and attachable to said top member;

an internal member for supporting photographs and messages, said internal member being a single piece having a plurality of viewing surfaces interconnected by narrow separating panels and attachable to said bottom member, said viewing surfaces and narrow separating panels adapted for mounting photographs and messages, respectively, thereto and clearly visible through said top member; whereby the photographs may be sealed within the Christmas tree ornament.

* * * * *